US006099623A

United States Patent [19]

Namatame et al.

[11] Patent Number: 6,099,623

[45] Date of Patent: Aug. 8, 2000

[54] HUMIDITY CONTROL APPARATUS

[75] Inventors: Tatsuo Namatame; Toshio Nakayama; Masuyuki Hashimoto; Sinji Kaneko, all of Osaka-fu, Japan

[73] Assignee: Sanyo Electric Co., Ltd., Osaka-fu, Japan

[21] Appl. No.: 09/256,667

[22] Filed: Feb. 24, 1999

[30] Foreign Application Priority Data

| | | | |
|---|---|---|---|
| Feb. 25, 1998 | [JP] | Japan | 10-043732 |
| Feb. 25, 1998 | [JP] | Japan | 10-043733 |
| Feb. 25, 1998 | [JP] | Japan | 10-043735 |
| Feb. 25, 1998 | [JP] | Japan | 10-043736 |

[51] Int. Cl.[7] ..... B01D 53/06

[52] U.S. Cl. ..... 96/125; 96/128; 96/130; 96/143; 96/150

[58] Field of Search ..... 96/122, 123, 125, 96/128, 130, 143, 146, 150

[56] References Cited

U.S. PATENT DOCUMENTS

| | | | |
|---|---|---|---|
| 2,264,221 | 11/1941 | Smith | 96/125 X |
| 3,009,684 | 11/1961 | Munters | 96/125 X |
| 3,398,510 | 8/1968 | Pennington | 96/125 X |
| 3,470,708 | 10/1969 | Weil et al. | 96/125 X |
| 3,844,737 | 10/1974 | Macriss et al. | 96/125 X |
| 4,060,913 | 12/1977 | Yoshida et al. | 96/123 |
| 4,062,129 | 12/1977 | Yoshida et al. | 96/123 |
| 4,365,979 | 12/1982 | Takeyama et al. | 96/123 |
| 4,574,872 | 3/1986 | Yano et al. | 96/125 |
| 4,729,774 | 3/1988 | Cohen et al. | 96/123 |
| 5,170,633 | 12/1992 | Kaplan | 96/125 X |
| 5,242,473 | 9/1993 | Ogasahara | 96/146 X |
| 5,526,651 | 6/1996 | Worek et al. | 96/143 X |
| 5,584,916 | 12/1996 | Yamashita et al. | 96/123 |
| 5,709,736 | 1/1998 | Fujimura | 96/146 X |
| 5,931,015 | 8/1999 | Maeda | 96/123 X |

*Primary Examiner*—Robert H. Spitzer
*Attorney, Agent, or Firm*—Weingarten, Schurgin, Gagnebin & Hayes LLP

[57] ABSTRACT

A humidity control apparatus for realizing the dehumidification, humidification, and ventilation operations in a compact configuration. The apparatus includes a rotary humidity control element, an electric heater, and sucking and/or forcing blowers. The rotary humidity control element is of metal silicate gel polymerized in honeycomb laminates of ceramics, and is sectioned into a drying function part, a heat recovery function part, and a humidification function part, for use. The drying function part absorbs and removes moisture from air passing therethrough at room temperatures. The heat recovery function part recovers heat of air passing therethrough. The humidification function part moistens the air passing therethrough if the air is high in temperature. The electric heater is provided on an air passageway between the heat recovery function part and the humidification function part, for heating the air to be introduced to the humidification function part. The first suction- or forcing blower is provided on a first air passageway, and the second suction- or forcing blower is provided on a second air passageway. By the action of the blowers, an outdoor and interior airs are fetched from the exterior and the interior respectively, passed through the rotary humidity control element, and discharged. The air passageways are changed so that the apparatus is operated for dehumidification, humidification, or ventilation selectively.

16 Claims, 8 Drawing Sheets

HUMIDITY CONTROL APPARATUS

BACKGROUND OF THE INVENTION

1. Field of the Invention

The present invention relates to a humidity control apparatus, and more particularly an apparatus, which can perform dehumidification, humidification, and/or ventilation according to need.

2. Description of the Related Art

Some general-purpose air conditioners used mainly for temperature control can be operated for dehumidification.

As humidifiers, ones in which water stored in a container is heated and vaporized for humidification are well known.

Heretofore, there has not been provided a compact and complete humidity control apparatus that can be selectively operated, for dehumidification and humidification. In other words, humidity control apparatuses for performing both dehumidification and humidification selectively are partly proposed, but in the form of a combination of single-functioned apparatuses for dehumidification, humidification, and ventilation, or in the form of a combination of multi- and single-functioned apparatuses. This gives rise to a problem in larger size of the apparatus and lower facility of maintenance. In addition, most of those apparatuses require the supply of water for humidification and the disposing of water produced in dehumidification, thereby resulting in a problem in poor usability.

SUMMARY OF THE INVENTION

In view of the foregoing, an object of the present invention is, to solve the aforesaid problems, to provide a humidity control apparatus utilizing one rotary humidity control element for dehumidification, humidification, and ventilation functions, thereby realizing the three functions in a simple configuration.

Another object of the present invention is to provide a humidity control apparatus that can be miniaturized although it has the three functions.

Still further object of the present invention is to provide a humidity control element in which no drain water is produced in the dehumidification and no water supply is required in the humidification, thereby improving its usability.

The foregoing object and other objects of the invention have been achieved by the provision of humidity control apparatuses in first through twelfth configurations as described hereinafter.

The present invention provides a humidity control apparatus in a first configuration comprising: a rotary humidity control element having a drying function part for letting an outdoor air fetched from an exterior side pass therethrough so as to absorb and remove moisture in the air and to discharge the resulting dry air into the exterior, a heat recovery function part for letting an interior air fetched from an interior side pass therethrough so as to recover heat therefrom, and a humidification function part for letting the air having passed through said heat recovery function part pass therethrough so as to supply the air with moisture and to discharge the resulting moist air to the interior; heating means for applying heating treatment to the air having passed through said heat recovery function part so that the resulting air increased in temperature passes through said humidification function part; a first sucking blower provided on a first air passageway, through which said outdoor air is fetched, at a downstream side of said drying function part; and a second sucking blower provided on a second air passageway, through which said interior air is fetched, at a downstream side of said humidification function part.

The present invention further provides a humidity control apparatus in a second configuration according to the aforesaid apparatus in the first configuration, wherein passageway changing means are provided on the air passageways so that: the outdoor air fetched by the first sucking blower sequentially passes through said heat recovery function part and said humidification function part, and is discharged into the exterior side; and the interior air fetched by the second sucking blower passes through said drying function part, and is discharged into the interior side.

In addition, the present invention provides a humidity control apparatus in a third configuration according to the aforesaid apparatus in the first or the second configuration, wherein passageway changing means are provided on the air passageways so that: the interior air fetched by the first sucking blower passes through said drying function part, and is discharged into the exterior side; and the outdoor air fetched by the second sucking blower sequentially passes through said heat recovery function part and said humidification function part, and is discharged into the interior side.

Furthermore, the present invention provides a humidity control apparatus in a fourth configuration according to the aforesaid apparatus in the first configuration: wherein instead of the first sucking blower, a first forcing blower is provided on the first air passageway at an upstream side of said drying function part; and, instead of the second sucking blower, a second forcing blower is provided on the second air passageway at an upstream side of said heat recovery function part.

In addition, the present invention provides a humidity control apparatus in a fifth configuration according to the aforesaid apparatus in the fourth configuration, wherein passageway changing means are provided on the air passageways so that: the outdoor air fetched by the first forcing blower sequentially passes through said heat recovery function part and said humidification function part, and is discharged into the exterior side; and the interior air fetched by the second forcing blower passes through said drying function part, and is discharged into the interior side.

Still further, the present invention provides a humidity control apparatus in a sixth configuration according to the aforesaid apparatus in the fourth or the fifth configuration, wherein passageway changing means are provided on the air passageways so that: the outdoor air fetched by the first forcing blower sequentially passes through said heat recovery function part and said humidification function part, and is discharged into the interior side; and the interior air fetched by the second forcing blower passes through said drying function part, and is discharged into the exterior side.

In addition, the present invention provides a humidity control apparatus in a seventh configuration according to the aforesaid apparatus in the first configuration, wherein instead of the second sucking blower, a forcing blower is provided on the second air passageway at an upstream side of said heat recovery function part.

Furthermore, the present invention provides a humidity control apparatus in an eighth configuration according to the aforesaid apparatus in the seventh configuration, wherein passageway changing means are provided on the air passageways so that: the outdoor air fetched by the sucking blower sequentially passes through said heat recovery function part and said humidification function part, and is discharged into the exterior side; and the interior air fetched by the forcing blower passes through said drying function part, and is discharged into the interior side.

In addition, the present invention provides a humidity control apparatus in a ninth configuration according to the aforesaid apparatus in the seventh or the eighth configuration, wherein passageway changing means are provided on the air passageways so that: the interior air fetched by the forcing blower passes through said drying function part; and the interior air having passed through said drying function part is discharged into the exterior by the cooperative action of the forcing and the sucking blowers.

In addition, the present invention provides a humidity control apparatus in a tenth configuration according to the aforesaid apparatus in the first configuration, wherein instead of the first sucking blower, a forcing blower is provided on the first air passageway at an upstream side of said drying function part.

Still further, the present invention provides a humidity control apparatus in an eleventh configuration according to the aforesaid apparatus in the tenth configuration, wherein passageway changing means are provided on the air passageways so that: the outdoor air fetched by the forcing blower sequentially passes through said heat recovery function part and said humidification function part, and is discharged into the exterior side; and the interior air fetched by the sucking blower passes through said drying function part, and is discharged into the interior side.

In addition, the present invention provides a humidity control apparatus in a twelfth configuration according to the aforesaid apparatus in the tenth or the eleventh configuration, wherein passageway changing means are provided on the air passageways so that the outside air fetched by the sucking blower passes through said drying function part and is discharged into the interior.

DETAILED DESCRIPTION OF THE PREFERRED EMBODIMENTS

First Embodiment

Figure 1:
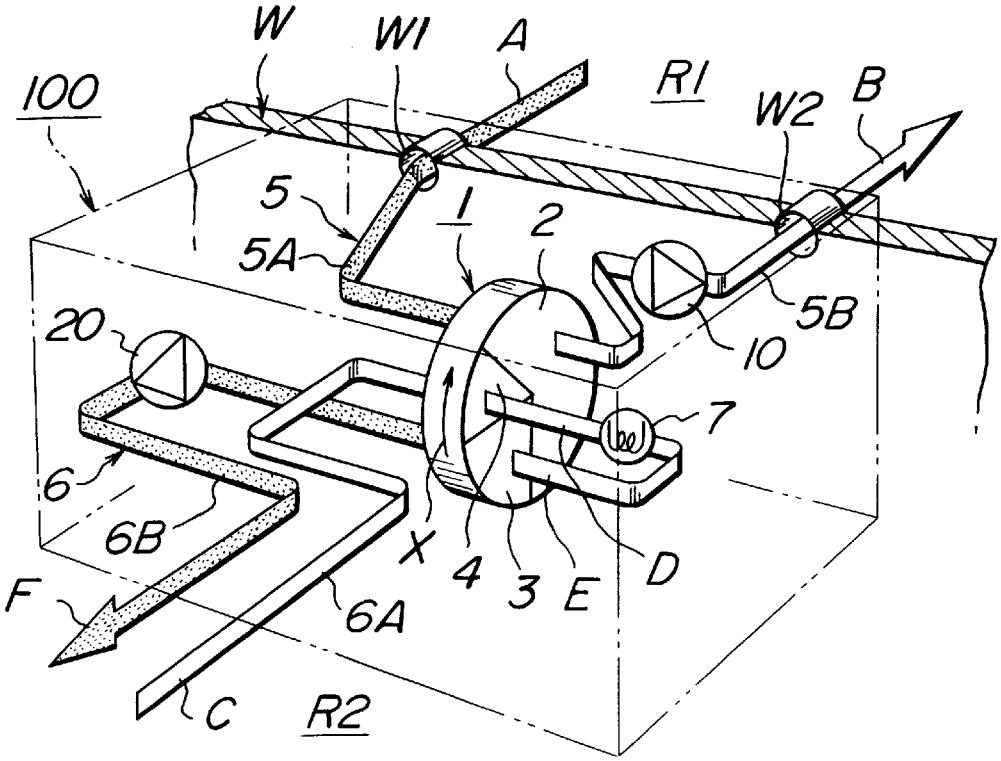
FIG. 1 is an explanatory diagram showing air passageways in humidification operation according to a first embodiment of the present invention.

A first embodiment of the present invention will be described with reference to FIGS. 1–3. FIG. 1 shows air passageways of a humidity control apparatus in humidification operation. Designated by the reference numeral 1 is a rotary humidity control element built in a case body 100 installed onto, for example, the interior-side of a sidewall W. The rotary humidity control element 1 is provided in such a manner that: metal silicate gel made by combining silica gel and a plurality of metals such as cobalt, iron, and manganese, is polymerized in honeycomb laminates of ceramics; and micro-pores thereof are fine adjusted in shape to match with water molecules as well as have plenty of hydroxyls fixed inside to increase their hydrophilicity. Thereby, the rotary humidity control element 1 absorbs moisture in the air at room temperatures, and releases the absorbed moisture at temperatures of 130–140° C. Here, the rotary humidity control element 1 is cylindrical in shape, the diameter of which is 20 cm, for example, and is controlled to rotate ½ round per minute, for example.

The rotary humidity control element 1 is sectioned into a drying function part 2, a humidification function part 3, and a heat recovery function part 4, for use. The drying function part 2 lets a low-temperatured air fetched from outside the apparatus pass therethrough so as to absorb and remove moisture in the air. The humidification function part 3 lets a heated and high-temperatured air pass therethrough so as to supply the air with moisture and to restore the function to absorb moisture at the part of the element. The heat recovery function part 4 lets a low-temperatured air fetched from outside the apparatus pass through the high-temperatured portion thereof so as to increase the passing air in temperature and to decrease the rotary humidity controlling element 1 in temperature.

The drying function part 2, the humidification function part 3, and the heat recovery function part 4 may be in the area ratio of 3:1:1, for example. The airflow ratio between the drying function part 2 and the humidification function part 3 (the heat recovery function part 4, also) may be set in 80 ($m_3$/h):30($m^3$/h). Designated by X i s the rotation direction of the rotary humidity control element 1.

In the case body 100, a first air passageway 5 is formed so that an outdoor air A from the exterior R1 passes through the drying function part 2 of the rotary humidity control element 1. A first sucking blower 10 is provided on the first air passageway 5 at a downstream side 5B of the drying function part 2.

By sucking, the first sucking blower 10 fetches the outdoor air A in the exterior R1 through an intake vent W1 opening in the side wall W at the up stream side 5A of the first air passageway 5. The outdoor air A passes through the drying function part 2, thereby having its moisture absorbed and being dried. The dried air B resulting from the drying process is discharged into the exterior R1 through an exhaust vent W2 opening in the side wall W at the downstream side 5B of the first air passageway 5.

Besides, in the case body 100, a second air passageway 6 is formed so that an interior air C from the interior R2 passes through passageway 6A to the heat recovery function part 4 of the rotary humidity control element 1. The second air passageway 6 comprises a route which passes through the heat recovery function part 4, makes a U-turn, passes through the humidification function part 3, and leads to the interior R2. On a downstream side 6B of the humidification function part 3 is provided a second sucking blower 20.

By sucking, the second sucking blower 20 fetches the interior air C, and passes the interior air C through the heat recovery function part 4 so as to recover heat from the rotary humidity control element 1. Past the heat recovery function part 4, the heat recovery air D resulting from the heat recovery process is heated by an electric heater 7 as a heating means. The high-temperatured air E resulting from the heating passes through the humidification function part 3. Accordingly, the separating and releasing of the moisture absorbed in the rotary humidity control element 1 moistens the interior air C, the rotary humidity control element 1 restores its moisture sorbability, and the moist air F humidified thus is discharged into the interior R2. By this means, the humidification of the interior R2 is performed.

Figure 2:
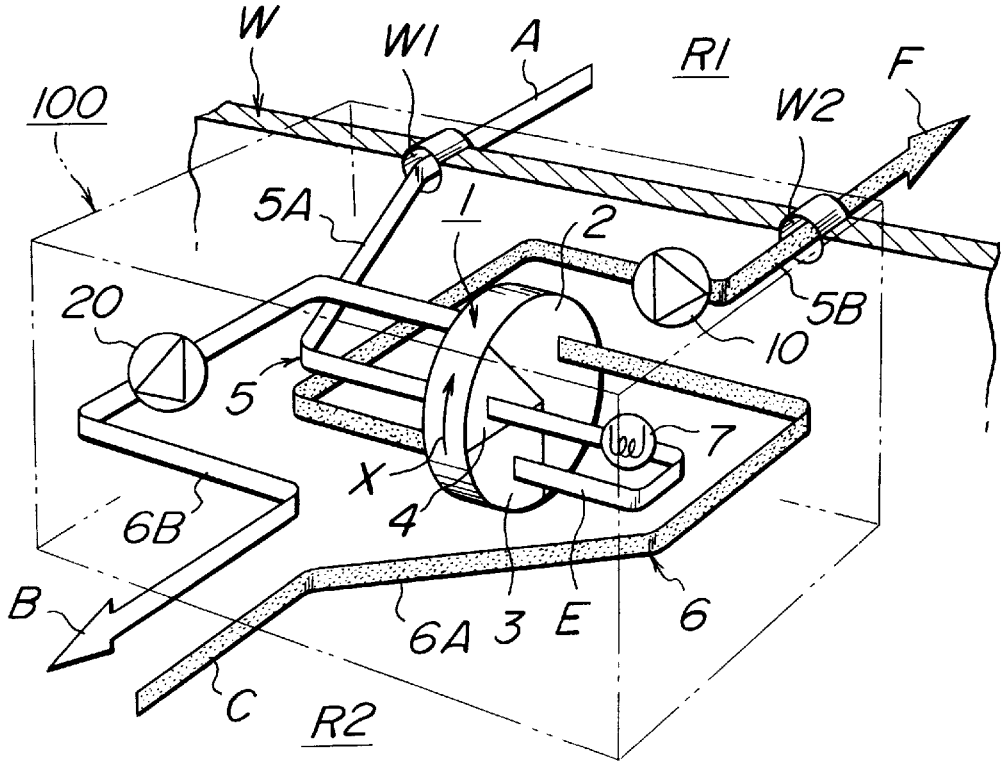
FIG. 2 is an explanatory diagram showing air passageways in dehumidification operation according to the first embodiment.

FIG. 2 shows air passageways of the humidity control apparatus in dehumidification operation. Here, the air passages are changed so that: the interior air C fetched from the interior R2 by the second sucking blower 20 passes through passageway 6A to the drying function part 2 to be dehumidified and dried; and the dry air B dried by passing through the drying function part 2 is discharged into the interior R2. Furthermore, the air passages are changed so that: the outdoor air A fetched from the exterior R1 by the first sucking blower 10 passes through the heat recovery function part 4; and the high-temperatured air E heated by the electric heater 7 past the heat recovery function part 4 passes through the humidification function part 3, deprives moisture from the rotary humidity control element 1 to restore the moisture sorbability at the part thereof, and is discharged into the exterior R1 as a moist air F.

Figure 3:
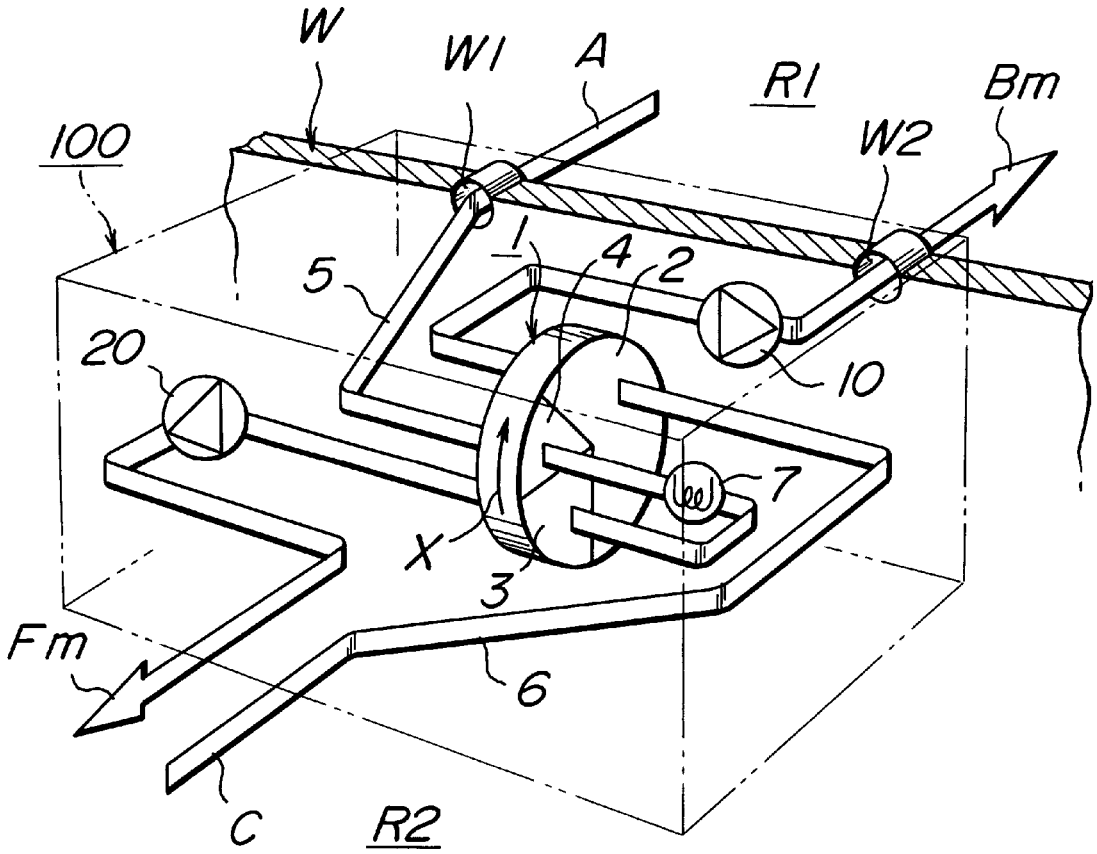
FIG. 3 is an explanatory diagram showing air passageways in ventilation operation according to the first embodiment.

FIG. 3 shows air passageways of the humidity control apparatus in ventilation operation performed with the heating by the electric heater 7 suspended. Here, the air passageways are changed so that the interior air C fetched from the interior R2 by the first sucking blower 10 passes through the drying function part 2, and that an apparent dry air Bm is discharged into the exterior R1. Although having passed through the drying function part 2, the apparent dry air Bm actually bears little change in humidity as compared to the interior air C, since the drying function part 2 has not restored its moisture sorbability. This is because no absorbed moisture is deprived from the humidification function part 3. In the meantime, the air passageways are also changed so that the outdoor air A fetched from the exterior R1 by the second sucking blower 20 passes through the heat recovery function part 4, and that an apparent moist air Fm is discharged into the interior R2. The apparent moist air Fm actually bears little change in humidity as compared to the outdoor air A, because of no increase in temperature when passing through the humidification function part 3 after the heat recovery function part 4.

In addition, since ventilation is performed while the heat exchange is also achieved between the outdoor air A and the interior air C, the heat efficiency during ventilation is high when the interior R2 is under heating or cooling. For example, in heating operation in which the temperature of the interior air C is higher than that the outdoor air A, the passing of the interior air C fetched by the first sucking blower 10 increases the temperature of the rotary humidity control element 1 via the drying function part 2. The low-temperatured outdoor air A fetched by the second sucking blower 20 passes through the temperature-increased rotary humidity control element 1 at the heat recovery function part 4 and the humidification function part 3 in sequence. Thereby, the outdoor air A is increased in temperature and discharged into the interior R2. This lowers the temperature loss in the ventilation, and thereby saving energy in cooling and heating operations.

Second Embodiment

Figure 4:
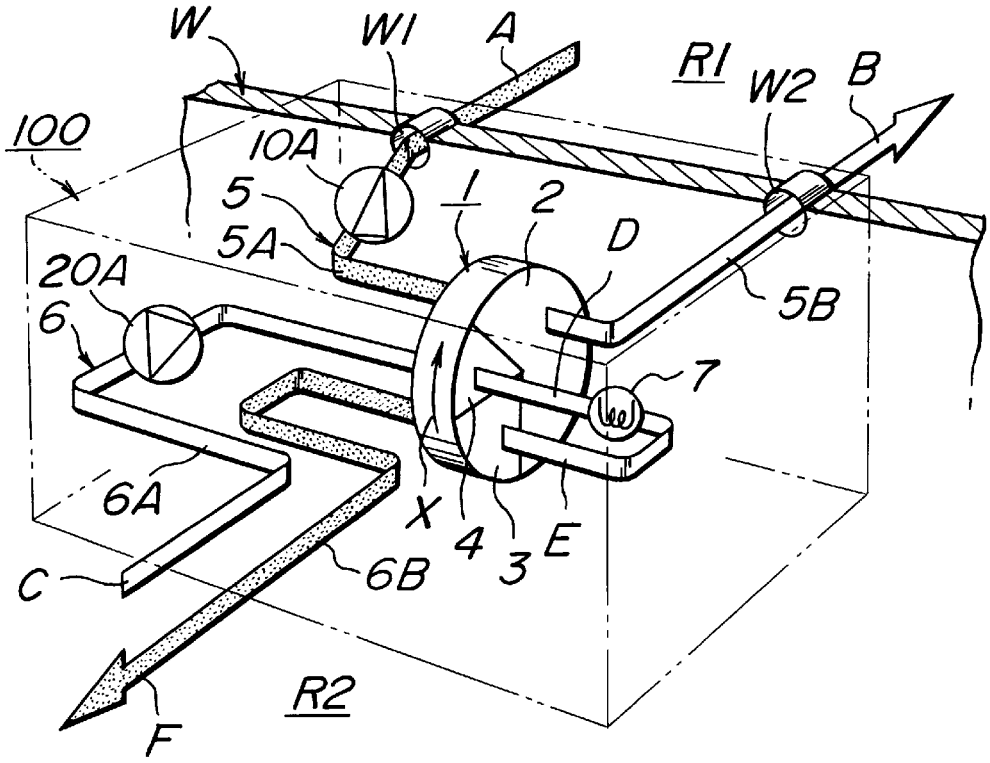
FIG. 4 is an explanatory diagram showing air passageways in humidification operation according to a second embodiment of the present invention.
Figure 5:
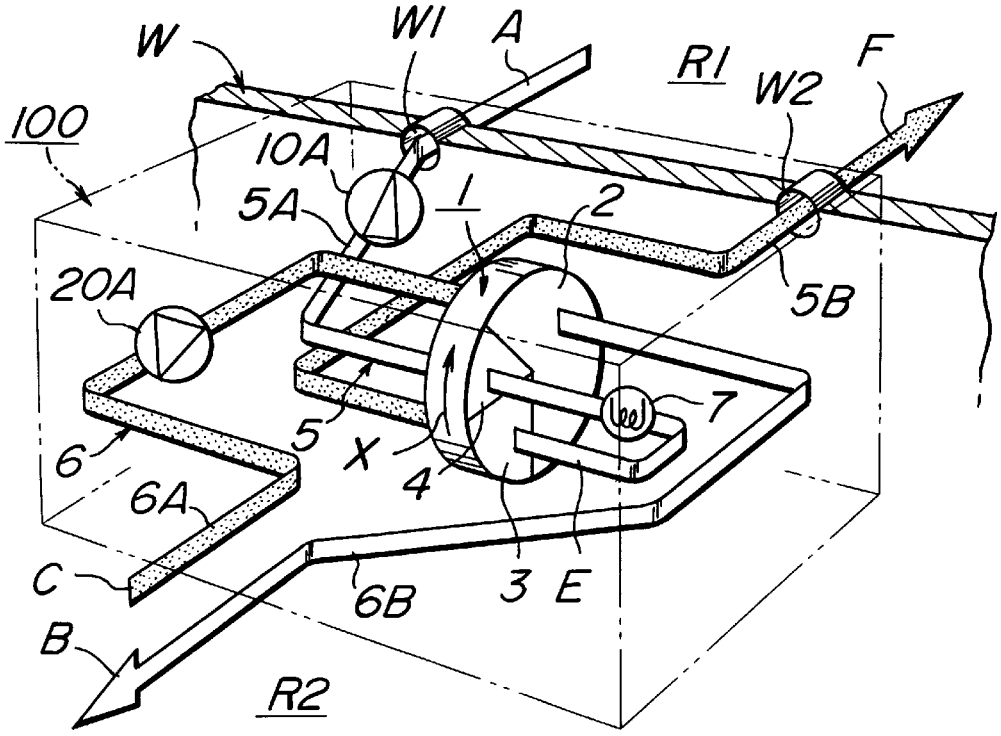
FIG. 5 is an explanatory diagram showing air passageways in dehumidification operation according to the second embodiment.
Figure 6:
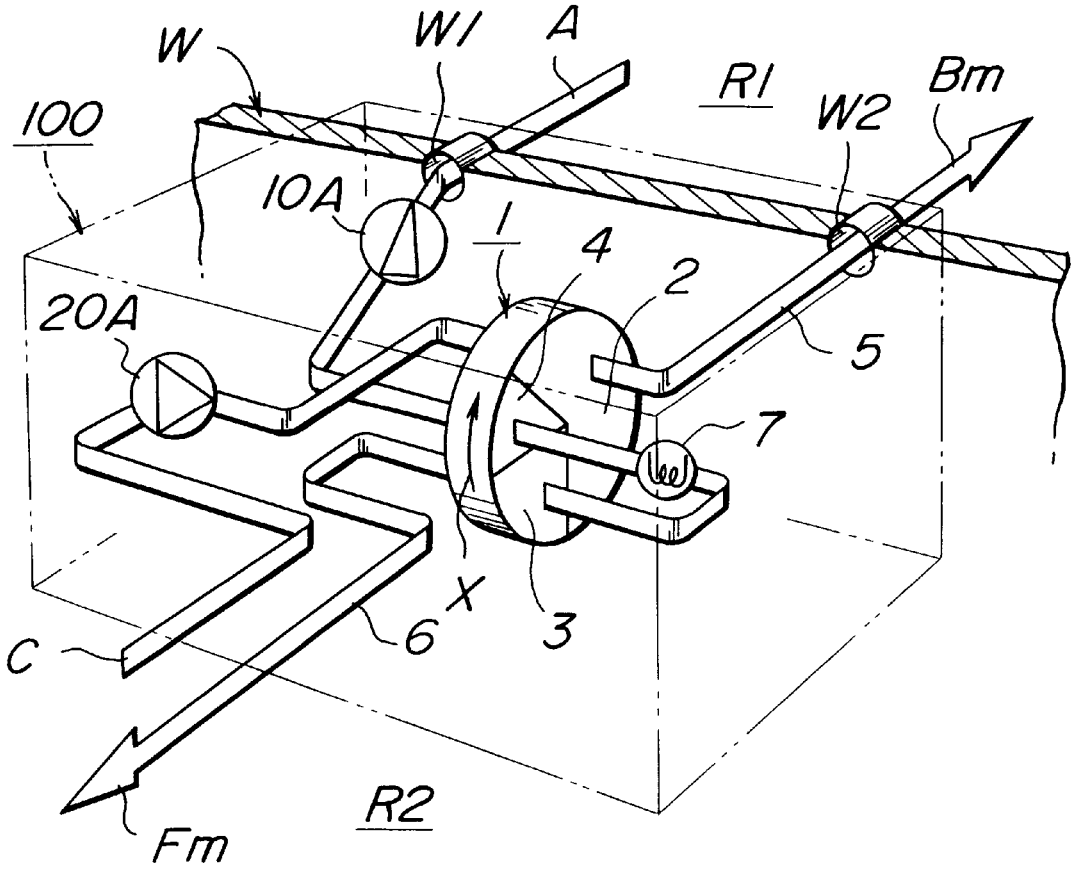
FIG. 6 is an explanatory diagram showing air passageways in ventilation operation according to the second embodiment.

A second embodiment of the present invention will be described with reference to FIGS. 4–6. Instead of the first and second sucking blower 10 and 20 used in the aforesaid humidity control apparatus of the first embodiment, this humidity control apparatus of the second embodiment comprises a first forcing blower 10A on the first air passageway 5 at the upstream side 5A of the drying function part 2 and a second forcing blower 20A on the second air passageway 6 at the upstream side 6A of the heat recovery function part 4. In the humidification operation and the dehumidification operation in which the electric heater 7 is energized for heating, the humidity control apparatus is operated with the air passageways formed as shown in FIGS. 4 and 5, respectively. In the ventilation operation without energizing the electric heater 7, the humidity control apparatus is operated with the air passageways formed as shown in FIG. 6. Thus, both the airs fetched from the exterior R1 and the interior R2 flow as in the humidity control apparatus of the first embodiment. Therefore, this humidity control apparatus of the second embodiment provides the same functions and effects as the humidity control apparatus of the first embodiment.

Third Embodiment

Figure 7:
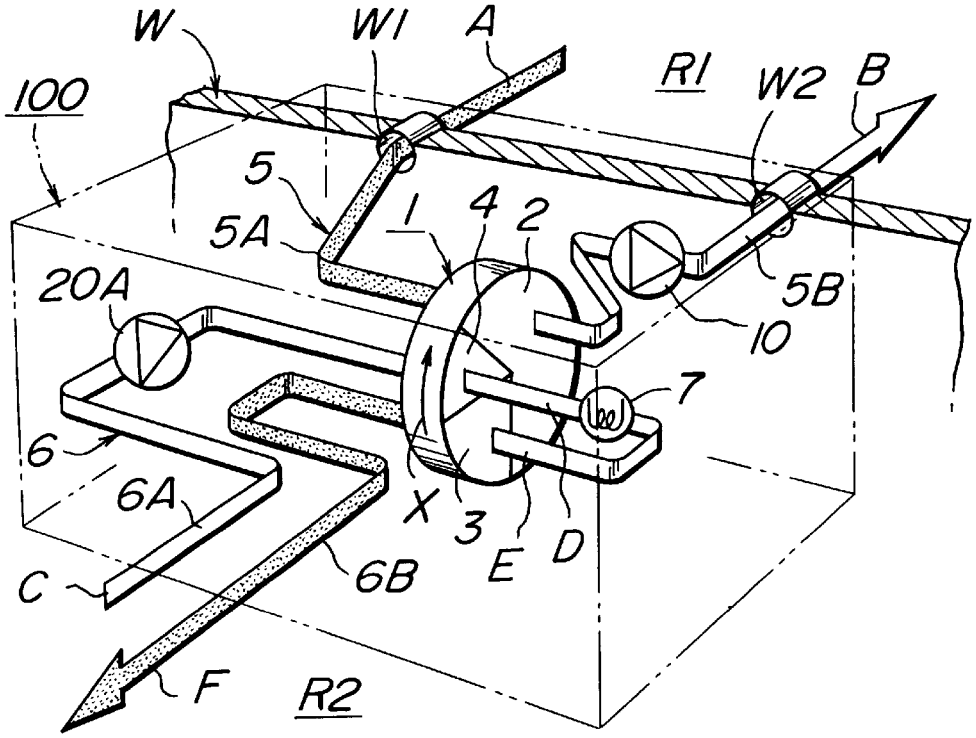
FIG. 7 is an explanatory diagram showing air passageways in humidification operation according to a third embodiment of the present invention.
Figure 8:
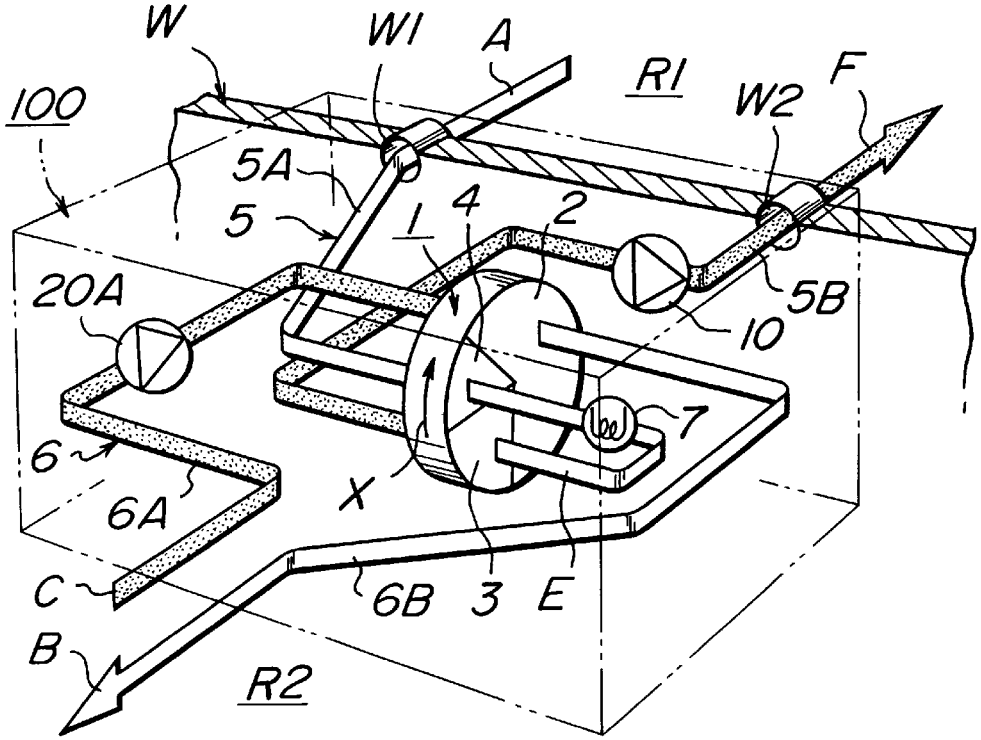
FIG. 8 is an explanatory diagram showing air passageways in dehumidification operation according to the third embodiment.

A third embodiment of the present invention will be described with reference to FIGS. 7–9. Instead of the second sucking blower 20 used in the humidity control apparatus of the aforesaid first embodiment, this humidity control apparatus of the third embodiment comprises a forcing blower 20A provided on the second air passageway 6 at the upstream side 6A of the heat recovery function part 4. In the humidification operation and the dehumidification operation in which the electric heater 7 is energized for heating, the humidity control apparatus is operated with the air passageways formed as shown in FIGS. 7 and 8, respectively. Thus, in the humidification operation and the dehumidification operation, both the airs fetched from the exterior R1 and from the interior R2 flow as in the aforesaid humidity control apparatuses of the first and second embodiments. Therefore, in these operations, the same functions and effects as in the aforesaid humidity control apparatuses of the first and second embodiments are obtained.

Figure 9:
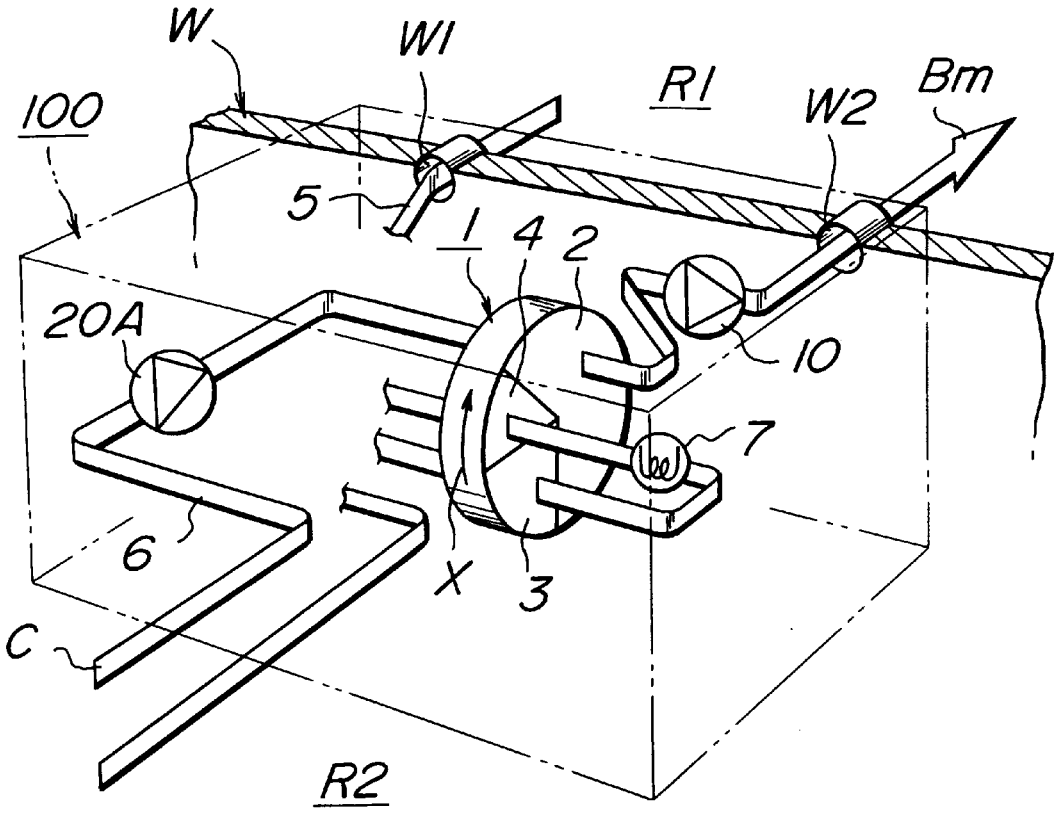
FIG. 9 is an explanatory diagram showing air passageways in ventilation operation according to the third embodiment.

On the other hand, in the ventilation operation in which the energizing of the electric heater 7 is suspended, the air passageways are formed as shown in FIG. 9. The interior air C fetched from the interior side R2 by the forcing blower 20A passes through the drying function part 2 of the rotary humidity control element 1, and is discharged into the exterior R1 by the cooperative action of the forcing blower 20A and the first sucking blower 10. When the electric heater 7 is not energized, the drying function part 2 has no drying function for the passing air, as described above. Therefore, the apparent dry air Bm of little change in humidity is discharged into the exterior R1.

Fourth Embodiment

Figure 10:
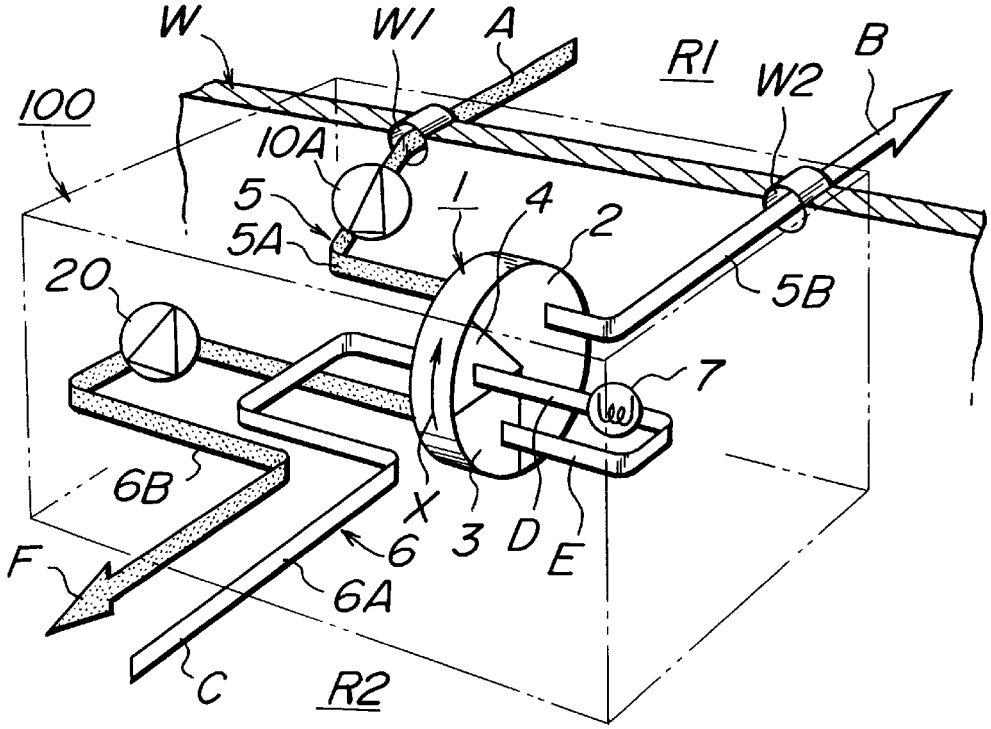
FIG. 10 is an explanatory diagram showing air passageways in humidification operation according to a fourth embodiment of the present invention.
Figure 11:
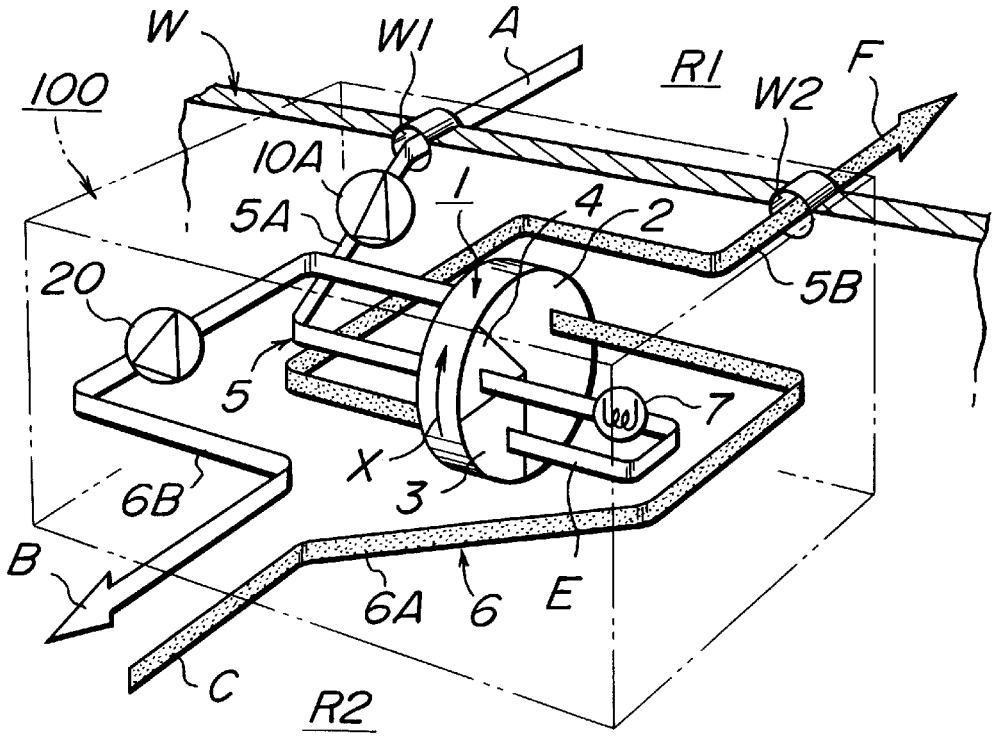
FIG. 11 is an explanatory diagram showing air passageways in dehumidification operation according to the fourth embodiment.

A fourth embodiment of the present invention will be described with reference to FIGS. 10–12. Instead of the first sucking blower 10 used in the humidity control apparatus of the aforesaid first embodiment, this humidity control apparatus of the fourth embodiment comprises a forcing blower 10A provided on the first air passageway 5 at the upstream side 5A of the drying function part 2. In the humidification operation and the dehumidification operation in which the electric heater 7 is energized for heating, the humidity control apparatus is operated with the air passageways formed as shown in FIGS. 10 and 11, respectively. Here, in the humidification operation and the dehumidification operation, both the airs fetched from the exterior R1 and from the interior R2 flow as in the aforesaid humidity control apparatuses of the first, second, and third embodiments. Therefore, in these operations, the same functions and effects as in the aforesaid humidity control apparatuses of the first, second, and third embodiments are obtained.

Figure 12:
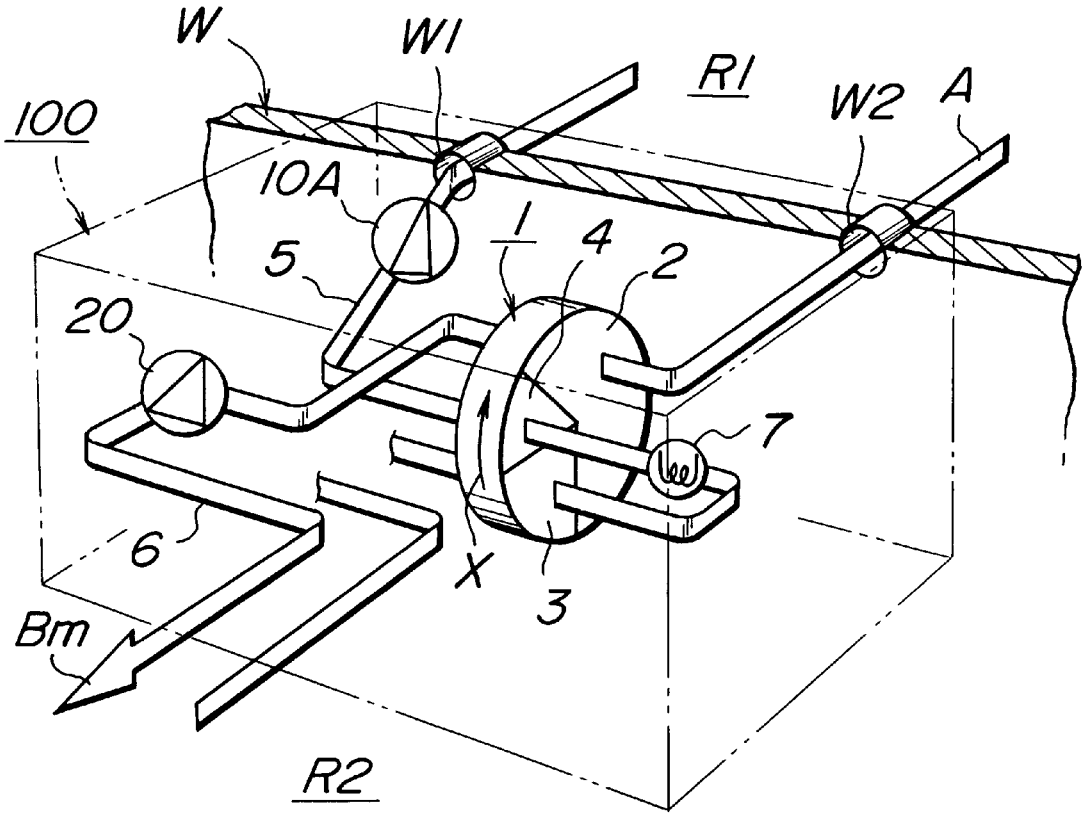
FIG. 12 is an explanatory diagram showing air passageways in ventilation operation according to the fourth embodiment.

On the other hand, in the ventilation operation in which the energizing of the electric heater 7 is suspended, the air passageways are formed as shown in FIG. 12. The outdoor air A fetched from the exterior R1 by the sucking blower 20 passes through the drying function part 2 of the rotary humidity control element 1, and is discharged into the interior R2. When the electric heater 7 is not energized, the drying function part 2 has no drying function for the passing air, as mentioned above. Therefore, the apparent dry air Bm of little change in humidity is discharged into the interior R2.

As described above, according to the humidity control apparatus of the present invention, dehumidification, humidification, and ventilation functions are performed by utilizing one rotary humidity control element. Therefore, an apparatus with the three functions can be realized in a simple configuration, and thereby allowing the miniaturization of the apparatus. Besides, no drain water is produced in the dehumidification and no water supply is required in the humidification, thereby improving its usability.

While there has been described what are at present considered to be preferred embodiments of the invention, it will be understood that various modifications may be made thereto, and it is intended that the appended claims cover all such modification as fall within the true spirit and scope of the invention.

What is claimed is:

1. A humidity control apparatus comprising:

a rotary humidity control element having a drying function part for letting an outdoor air fetched from an exterior side pass therethrough so as to absorb and remove moisture in the air and to discharge the resulting dry air into the exterior, a heat recovery function part for letting an interior air fetched from an interior side pass therethrough so as to heat recover, and a humidification function part for letting the air having passed through said heat recovery function part pass therethrough so as to supply the air with moisture and to discharge the resulting moist air to the interior;

heating means for applying heating treatment to the air having passed through said heat recovery function part so that the resulting air increased in temperature passes through said humidification function part;

a first sucking blower provided on a first air passageway, through which said outdoor air is fetched, at a downstream side of said drying function part; and a second sucking blower provided on a second air passageway, through which said interior air is fetched, at a downstream side of said humidification function part.

2. The humidity control apparatus according to claim 1, wherein passageway changing means are provided on the air passageways so that:

the outdoor air fetched by the first sucking blower sequentially passes through said heat recovery function part and said humidification function part, and is discharged into the exterior side; and the interior air fetched by the second sucking blower passes through said drying function part, and is discharged into the interior side.

3. The humidity control apparatus according to claim 2, wherein passageway changing means are provided on the air passageways so that:

the interior air fetched by the first sucking blower passes through said drying function part, and is discharged into the exterior side; and the outdoor air fetched by the second sucking blower sequentially passes through said heat recovery function part and said humidification function part, and is discharged into the interior side.

4. The humidity control apparatus according to claim 1, wherein passageway changing means are provided on the air passageways so that:

the interior air fetched by the first sucking blower passes through said drying function part, and is discharged into the exterior side; and the outdoor air fetched by the second sucking blower sequentially passes through said heat recovery function part and said humidification function part, and is discharged into the interior side.

5. The humidity control apparatus according to claim 1, wherein:

instead of the first sucking blower, a first forcing blower is provided on the first air passageway at an upstream side of said drying function part; and, instead of the second sucking blower, a second forcing blower is provided on the second air passageway at an upstream side of said heat recovery function part.

6. The humidity control apparatus according to claim 5, wherein passageway changing means are provided on the air passageways so that:

the outdoor air fetched by the first forcing blower sequentially passes through said heat recovery function part and said humidification function part, and is discharged into the exterior side; and the interior air fetched by the second forcing blower passes through said drying function part, and is discharged into the interior side.

7. The humidity control apparatus according to claim 6, wherein passageway changing means are provided on the air passageways so that:

the outdoor air fetched by the first forcing blower sequentially passes through said heat recovery function part and said humidification function part, and is discharged into the interior side; and the interior air fetched by the second forcing blower passes through said drying function part, and is discharged into the exterior side.

8. The humidity control apparatus according to claim 5, wherein passageway changing means are provided on the air passageways so that:

the outdoor air fetched by the first forcing blower sequentially passes through said heat recovery function part and said humidification function part, and is discharged into the interior side; and the interior air fetched by the second forcing blower passes through said drying function part, and is discharged into the exterior side.

9. The humidity control apparatus according to claim 1, wherein, instead of the second sucking blower, a forcing blower is provided on the second air passageway at an upstream side of said heat recovery function part.

10. The humidity control apparatus according to claim 9, wherein passageway changing means are provided on the air passageways so that:

the outdoor air fetched by the sucking blower sequentially passes through said heat recovery function part and said humidification function part, and is discharged into the exterior side; and the interior air fetched by the forcing blower passes through said drying function part, and is discharged into the interior side.

11. The humidity control apparatus according to claim 10, wherein passageway changing means are provided on the air passageways so that:

the interior air fetched by the forcing blower passes through said drying function part; and the interior air having passed through said drying function part is discharged into the exterior by the cooperative action of the forcing and the sucking blowers.

12. The humidity control apparatus according to claim 9, wherein passageway changing means are provided on the air passageways so that:

the interior air fetched by the forcing blower passes through said drying function part; and the interior air having passed through said drying function part is discharged into the exterior by the cooperative action of the forcing and the sucking blowers.

13. The humidity control apparatus according to claim 1, wherein, instead of the first sucking blower, a forcing blower is provided on the first air passageway at an upstream side of said drying function part.

14. The humidity control apparatus according to claim 13, wherein passageway changing means are provided on the air passageways so that:

the outdoor air fetched by the forcing blower sequentially passes through said heat recovery function part and said humidification function part, and is discharged into the exterior side; and the interior air fetched by the sucking blower passes through said drying function part, and is discharged into the interior side.

15. The humidity control apparatus according to claim 14, wherein passageway changing means are provided on the air passageways so that the outside air fetched by the sucking blower passes through said drying function part and is discharged into the interior.

16. The humidity control apparatus according to claim 13, wherein passageway changing means are provided on the air passageways so that the outside air fetched by the sucking blower passes through said drying function part and is discharged into the interior.

* * * * *